United States Patent [19]

Gehrig et al.

[11] 4,213,809

[45] Jul. 22, 1980

[54] WATER-RESISTANT EXTRUDABLE AQUEOUS GEL BLASTING AGENT AND SIMPLIFIED METHOD OF MANUFACTURE

[75] Inventors: Neil E. Gehrig, Westwood Hills; Edwin G. Marhofer, Pittsburg, both of Kans.

[73] Assignee: Gulf Oil Corporation, Pittsburgh, Pa.

[21] Appl. No.: 31,246

[22] Filed: Apr. 18, 1979

Related U.S. Application Data

[63] Continuation-in-part of Ser. No. 955,051, Oct. 26, 1978, abandoned.

[51] Int. Cl.[2] ..... C06B 31/30

[52] U.S. Cl. ..... 149/60; 149/74

[58] Field of Search ..... 149/60, 74

[56] References Cited

U.S. PATENT DOCUMENTS 3,962,001 6/1976 Marhofer et al. ..... 149/74

*Primary Examiner*—Stephen J. Lechert, Jr.

*Attorney, Agent, or Firm*—Carl A. Cline

[57] ABSTRACT

A simplified aqueous gel ammonium nitrate suspension blasting agent is made by a procedure in which the step in which both solid and liquid ingredients are combined takes advantage of a balance of positive and negative heats of solution and the sensitivity of the composition is derived from the combination of hexamethylenetetramine and nitric acid. The blasting agent contains from 10 to 13 weight percent water and 75 to 85 weight percent ammonium nitrate, with no solid fuel, auxiliary oxidizers or sensitivity stabilizers.

6 Claims, No Drawings

WATER-RESISTANT EXTRUDABLE AQUEOUS GEL BLASTING AGENT AND SIMPLIFIED METHOD OF MANUFACTURE

This is a continuation-in-part of co-pending U.S. Pat. application Ser. No. 955,051, filed Oct. 26, 1978 now abandoned.

DESCRIPTION OF THE INVENTION

In U.S. Pat. No. 3,962,001 there is described a method of making a non-cap-sensitive aqueous gel explosive or blasting agent which contains a rather large percentage of hexamethylenetetramine as well as ammonium perchlorate to stabilize the composition against loss of sensitivity at lower temperatures. In order to obtain thorough mixing it has been advisable to use a liquid solution phase in at least one of the manufacturing steps and because of the loss of heat during the dissolving of ammonium nitrate it has frequently been necessary to supply heat from external sources.

We have discovered that both the composition and the method of manufacturing a non-cap-sensitive aqueous gel blasting agent may be simplified so that a low temperature sensitivity stabilizer is eliminated. Further, the effects of both positive and negative heats of solution may be balanced by use of a manufacturing procedure that eliminates the need for an external heat source. The simplified manufacturing procedure that eliminates the need for an external heat source is easily operated in the vicinity of the blasting site. For example, the ingredients may be combined in an ordinary concrete mixer to yield a finished composition, having the consistency of a thick grout or mortar, ready to be extruded or pumped into place by the use of a concrete pump having either a piston or peristaltic type of mechanism. It is recommended that the mixing equipment be given a protective coating to prevent corrosion. An epoxy resin coating has proved to be suitable for this purpose.

Briefly, the method of manufacturing a water-resistant extrudable aqueous gel blasting agent comprises the steps:

(a) Mixing a stabilizing amount of finely divided water-soluble hydroxy-substituted thickening agent with a substantial proportion, between one-tenth and three-fourths of the total amount of particulate solid ammonium nitrate to yield a substantially uniform mixture of particulate solids, (b) Adding to and mixing with the mixture of particulate solids of step (a) at least 6 percent hexamethylenetetramine by weight of the total composition, sufficient nitric acid, between 2 percent and 5 percent by weight of the total composition to yield a pH between 3.5 and 6.0 in the total composition and a quantity of water sufficient to produce a water content of 10 to 13 percent by weight of the total composition, to yield a substantially uniform mixture;

(c) Adding to and mixing with the mixture obtained in step (b) the remainder of the solid particulate ammonium nitrate, sufficient to yield a total ammonium nitrate content of 75 to 85 weight percent;

(d) Continuing mixing or allowing the mixture obtained in step (c) to stand for a period of time sufficient to permit the thickening effect of the hydroxy-substituted thickening agent to become substantially complete and (e) Mixing with the product of step (d) a quantity of cross-linking agent sufficient to react with the hydroxy-substituted thickening agent to produce a gelling effect, yielding an extrudable aqueous gel blasting agent.

The purpose of step (a) is to obtain a uniform distribution of the thickening agent. This substance is usually a polysaccharide gum such as guar gum and is supplied in finely divided form. When the thickening agent is mixed directly with water it is very difficult to prevent the formation of lumps, unless it has previously been mixed thoroughly with other solids or is added slowly with extremely vigorous mixing. An alternative solution to this problem is to use a purchased guar gum which has been rendered dispersible by agglomeration to a granular form or addition of a substance which delays hydration. There are available some industrial grades of guar gum which are so prepared that they have a temporarily inhibited hydration in acidic media. Viscosity of the aqueous dispersion of the gum begins to develop after 10 to 15 minutes, after which thickening occurs in a normal manner. This time lag is adequate to permit thorough mixing prior to thickening, so that formation of lumps is easily avoided. (See, for example, *Industrial Gums Second Ed.* Editor, Roy L. Whistler, pages 319–320, Academic Press 1973, for a description of these products.) By use of this specialized type of thickening agent, step (a) may then be omitted and the ammonium nitrate and gum may be mixed directly with the other ingredients in step (b). Prior to beginning the mixing of the composition, it is advisable to wet the walls of the mixer with a small portion of the water of the composition, before use, so as to make the walls slippery and to prevent a coating of solids from forming on the walls, making it difficult to clean the apparatus after use. The importance of keeping the mixing apparatus clean between periods of use is well understood by workers in the art.

In step (b) the mixing of hexamethylenetetramine, nitric acid and water produces heat but the dissolving of ammonium nitrate in water consumes heat. If all of the ammonium nitrate is added in this step, the cooling effect interferes with the dissolving of the hexamethylenetetramine. By mixing only a portion of the ammonium nitrate with the other ingredients, the need for an external heat source is avoided. This makes possible the use of simple mixing equipment, as, for example, a portable concrete mixer, which can be located at or near the blasting site.

Upon addition of the remainder of the ammonium nitrate in step (c) the composition is substantially complete.

In step (d) hydration of the thickening agent occurs, with a substantial increase in the viscosity of the aqueous solution phase.

In step (e) the cross-linking agent is added. This material may be an aqueous solution of chromic acid, zirconium sulfate and aluminum sulfate, as employed in U.S. Pat. No. 3,676,236, or, if greater storage stability is required, a solution of potassium pyroantimonate may be used. The cross-linking agent represents a minor proportion, usually about one percent by weight of the composition, or less. The cross-linked composition is a viscous gel of a thick grout or doughlike consistency which is highly resistant to water in bore holes and may be pumped or extruded into place with a concrete pump of the tube-squeezing type.

The finished compositions comprise by weight at least 6 percent hexamethylenetetramine, 2 to 5 percent nitric acid, 75 to 85 percent ammonium nitrate, about one-half to one and one-half percent water-soluble thickening agent and 10 to 13 percent water.

It is a common practice to employ as a blasting agent dry particulate ammonium nitrate uniformly impregnated with about 5 to 6 percent by weight of a light fuel oil. These so-called "oiled prills" of ammonium nitrate may be utilized in place of at least a substantial portion of the ammoniun nitrate in the present compositions. When mixing is done at the blasting site, it may happen that this is the form of ammonium nitrate which is most readily available. The appended claims are intended to encompass the use of ammonium nitrate in this form. The simplified procedure, employing a guar gum with temporarily inhibited hydration in acid media is as follows:

(a) Placing in a mixing apparatus from one-tenth to the total quantity of particulate solid ammonium nitrate in the composition, said total quantity being 75 to 85 percent by weight of the total composition;

(b) Adding to and mixing with the particulate solid ammonium nitrate of step (a) at least 6 percent hexamethylenetetramine by weight of the total composition, sufficient nitric acid, between 2 percent and 5 percent by weight of the total composition to yield a pH between 3.5 and 6.0 in the total composition and a quantity of water sufficient to produce a water content of 10 to 13 percent by weight of the total composition, to yield a substantially uniform mixture;

(c) Adding to and mixing with the mixture obtained in step (b) a stabilizing amount of a water-dispersible guar gum having the characteristic of temporarily inhibited hydration in acidic media and the remaining amount of the solid particulate ammonium nitrate, if any;

(d) Continuing mixing or allowing the mixture obtained in step (c) to stand for a period of time sufficient to permit the thickening effect of the water-dispersible guar gum to become substantially complete and (e) Mixing with the product of step (d) a quantity of cross-linking agent sufficient to react with the guar gum to produce a gelling effect, yielding an extrudable aqueous gel blasting agent.

The simplified procedure which employs the dispersible gum requires less time, partially because there is no thickening agent present in step (b). This makes possible more efficient mixing and reduced heat losses, so that it is feasible to mix all of the ammonium nitrate with acid, water and hexamethylenetetramine in step (b). For fast, efficient operation it may be preferred to meter an aqueous solution of hexamethylenetetramine and nitric acid into the water as it is being added to the mixer. If the extrudable characteristic of the composition is not necessary, the cross-linking agent may be added in step (c) and the composition can then be dumped into containers, allowing step (d) to occur in the finished package.

The practice of the invention is illustrated in the following examples.

EXAMPLE 1

In a wet cement mixer there was placed 25 parts by weight of prilled ammonium nitrate. The mixer was started and allowed to rotate for one minute, during which time it was observed that the ammonium nitrate was moving in the mixer as a free-flowing bed of particles. Rotation of the mixer was continued while 0.7 parts by weight of finely divided natural guar gum was added. Within 3 to 5 minutes the mixture was observed to be substantially uniform. There was then added to the mixer 8.5 parts by weight water, 6 parts by weight hexamethylenetetramine and 3.8 parts by weight of 54 percent nitric acid. Mixing was continued for 5 minutes to obtain a substantially uniform mixture and then 56 parts by weight of ammonium nitrate prills was added. Mixing was continued for another 5 minutes. The resulting mixture was then allowed to stand for one hour, during which time an increase in the viscosity of the liquid phase of the mixture was observed. One part by weight of a cross-linking solution containing 3 percent by weight chromic acid, 7 weight percent zirconium sulfate and 3 weight percent aluminum sulfate was then mixed thoroughly with the thickened mixture to produce a gel blasting composition of a doughlike consistency which was then extruded into place by means of a peristaltic concrete pump. The composition had a specific gravity of 1.3. At 60° F. (15.6° C.) a charge set in a steel pipe of three-inch internal diameter was detonated with a one pound cast high explosive primer, yielding a detonation velocity of 14,160 feet per second. A charge in a five-inch steel pipe yielded a detonation velocity of 16,720 feet per second.

EXAMPLE 2

In a concrete mixer there was placed 1000 parts by weight of prilled ammonium nitrate. While the last 200 parts of the ammonium nitrate were being placed in the mixer, 14 parts by weight of finely divided quar gum were also poured in and the solids were then mixed for 5 minutes. To the mixer there was then added 168 parts by weight water, 120 parts by weight hexamethylenetetramine and 75 parts by weight of 57 percent nitric acid and mixing was then continued for another 3 minutes, whereupon 628 parts of prilled ammonium nitrate was added and mixing was continued for another 5 minutes. The mixture was uniform and smooth but was at a temperature of 42° F. and was somewhat stiff because of the use of cold water for the mixing and the initial addition of a large porportion of the total ammonium nitrate content. The pH of the mixture was 5.5 and the specific gravity was 1.18. Upon standing for over one hour the composition was found to be stiff and extremely difficult to pump. The total water content of the mixture was about ten percent including the water content of the nitric acid. It was found to be necessary to keep the composition in motion by continuous mixing in order to make it feasible to add the cross-linking agent and to pump the composition with a concrete pump having a conduit with a three-inch inside diameter. The ten percent water content was judged to be a practical lower limit, so far as pumping with concrete handling equipment was concerned.

EXAMPLE 3

In order to study pumpability and detonation characteristics, batches of blasting agent were prepared substantially according to the procedure of Example 1 with various water contents. Charges were detonated at various temperatures in schedule 40 steel pipe with internal diameters of 5, 5¼ and 6 inch internal diameter. Results are tabulated below.

| Percent | Density | Temp. (°F.) | Charge Diameter (inches) | High Explosive Cast Booster (lbs.) | Velocity (Ft./Sec.) |
|---|---|---|---|---|---|
| 10 | 1.30 | 44 | 5 | 1 | 16,725 |
| 10 | 1.30 | 44 | 6 | 1 | 18,150 |
| 10 | 1.38 | 30 | 6 | 1 | 9,980 |
| 12 | 1.29 | 44 | 5 ¼ | 1 | 14,000 |
| 12 | 1.33 | 44 | 6 | 1 | 14,500 |
| 12 | 1.32 | 57 | 6 | 1 | 16,340 |
| 13 | 1.34 | 46 | 5 | 1 | 11,960 |
| 13 | 1.34 | 47 | 6 | 1 | 14,125 |
| 13 | 1.35 | 62 | 6 | 1 | 16,130 |
| 13 | 1.28 | 40 | 6 | 1 | 13,230 |
| 14 | 1.38 | 61 | 6 | 1 | Failed |

Although a higher water content made the compositions more easily pumped, it was evident that 13 percent was a practical upper limit because of failure to detonate at 14 percent water.

EXAMPLE 4

The walls of a concrete mixer were made wet by rotation after addition of 15 parts by weight of water. Then 500 parts by weight of prilled ammonium nitrate were placed in the mixer. Rotation was continued, so as to obtain a freely flowing moving bed of solid particles. To the moving bed was then added a mixture of 6.7 parts by weight of powdered natural guar gum and 0.3 parts by weight of a modified guar gum. Mixing was continued until the mixture of solids was substantially uniform.

While mixing was continued, there was then added 76 parts by weight of water, 70 parts by weight hexamethylenetetramine and 47.5 parts by weight of 67 percent nitric acid.

After the mixture appeared to be uniform, the mixer was allowed to run another 3 to 5 minutes so as to be sure that the gum was hydrated.

While continuing the mixing, 284.5 parts by weight of ammonium nitrate was added and the mixer was run until the mixture appeared to be smooth and uniform, a period of about 3 minutes. The mixer was then stopped and pH and density were measured. In repeating the above procedure several times, pH was found to vary from 3.5 to 4.5 and density varied from 1.2 to 1.3 g per $cm^3$.

The composition made according to the above procedure was transported in a truck-mounted mixer to the blasting site without rotation of the mixer. Upon arrival at the blasting site the mixer was rotated for a short period of time, between 3 and 5 minutes, prior to pumping into the blast holes. Total elapsed time between the previous mixing step and pumping was between one-half and one hour, sufficient to permit completion of the thickening effect.

A crosslinking solution was prepared by mixing 80 parts by weight water, 7 parts by weight zirconium sulfate, 10 parts by weight aluminum sulfate and 3 parts by weight chromic acid. During pumping of the blasting composition into place, 10 parts by weight of crosslinking solution was injected continuously into the exit stream from the pump (approximately one percent by weight of the total composition). The blasting composition was extruded through a flexible hose from the pump to the drilled blasting holes, where it was put in place in preparation for blasting.

EXAMPLE 5

A batch of extrudable blasting agent was prepared by means of the procedure set forth below. All parts and percentages are by weight, unless stated otherwise.

A cement mixer with a protective internal coating of expoxy resin was wet with a portion of the water of the composition, as in example 4, then 784 parts of particulate ammonium nitrate was charged to the mixer and there was added the remainder of a total of 91 parts of water, 70 parts of hexamethylenetetramine, 47.5 parts of 67 percent nitric acid and 7 parts of water-dispersible guar gum. Mixing was continued until a substantially uniform mixture of the desired density and consistency was obtained.

The above procedure was repeated, with a minor proportion (5 to 20 percent) of air-entraining guar gum replacing a part of the dispersible gum, so as to reduce the density of the composition to a desired value.

The batches of composition, prepared as disclosed above were pumped into place in drill holes, with crosslinking solution being injected continuously into the exit stream from the pump, as in Example 4.

We claim:

1. The method of manufacturing a water-resistant extrudable aqueous gel blasting agent comprising the steps:

(a) Mixing a stabilizing amount of finely divided water-soluble hydroxy-substituted thickening agent with a substantial proportion, between one-tenth and three-fourths of the total amount of particulate solid ammonium nitrate to yield a substantially uniform mixture of particulate solids.

(b) Adding to and mixing with the mixture of particulate solids of step (a) at least 6 percent hexamethylenetetramine by weight of the total composition, sufficient nitric acid, between 2 percent and 5 percent by weight of the total composition to yield a pH between 3.5 and 6.0 in the total composition and a quantity of water sufficient to produce a water content of 10 to 13 percent by weight of the total composition, to yield a substantially uniform mixture;

(c) Adding to and mixing with the mixture obtained in step (b) the remainder of the solid particulate ammonium nitrate, sufficient to yield a total ammonium nitrate content of 75 to 85 weight percent;

(d) Continuing mixing or allowing the mixture obtained in step (c) to stand for a period of time sufficient to permit the thickening effect of the hydroxy-substituted thickening agent to become substantially complete and (e) Mixing with the product of step (d) a quantity of cross-linking agent sufficient to react with the hydroxy-substituted thickening agent to produce a gelling effect, yielding an extrudable aqueous gel blasting agent.

2. The water-resistant extrudable aqueous gel blasting agent manufactured according to claim 1.

3. The water-resistant extrudable aqueous gel blasting agent consisting of a uniform mixture comprising 77.67 weight percent ammonium nitrate, 0.89 weight percent guar gum and crosslinking ingredients, 11.35 weight percent water, 6.9 weight percent hexamethylenetetramine and 3.2 weight percent nitric acid.

4. The method of manufacturing a water-resistant extrudable aqueous gel blasting agent, comprising the steps:

(a) Mixing together particulate ammonium nitrate amounting to 75 to 85 percent by weight of the total composition, at least 6 percent by weight hexamethylenetetramine, from 2 to 5 percent by weight nitric acid, from 10 to 13 percent by weight water and sufficient water-dispersible guar gum, from ½ to 1½ percent by weight to stabilize the resulting substantially uniform mixture;

(b) Continuing mixing or allowing the mixture in step (a) to stand for a period of time sufficient to permit the thickening effect to become substantially complete and (c) Mixing with the product of step (b) a quantity of cross-linking agent, sufficient to react with the guar gum to produce a gelling effect, yielding an extrudable aqueous gel blasting agent.

5. The water resistant extrudable aqueous gel blasting agent manufactured according to the method of claim 4.

6. The water-resistant extrudable aqueous gel blasting agent composition which comprises by weight, at least 6 percent hexamethylenetetramine, from 75 to 85 percent ammonium nitrate, from 10 to 13 percent water from 2 to 5 percent nitric acid and from ½ to 1½ percent of a water-soluble hydroxy-substituted thickening agent with sufficient cross-linking agent to produce a gelling effect.

* * * * *